US006405827B1

(12) United States Patent
Church

(10) Patent No.: US 6,405,827 B1
(45) Date of Patent: Jun. 18, 2002

(54) LOCK SEAM FOR CANISTERS

(75) Inventor: Russell Edward Church, Jackson, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 0 days.

(21) Appl. No.: 09/568,633

(22) Filed: May 10, 2000

(51) Int. Cl.[7] ..... F01N 7/18
(52) U.S. Cl. ..... 181/243; 181/282; 403/204
(58) Field of Search ..... 181/243, 241, 181/269, 272, 255, 282; 403/204

(56) References Cited

U.S. PATENT DOCUMENTS

| | | | | | |
|---|---|---|---|---|---|
| 2,107,588 | A | * | 2/1938 | Smith | 181/243 |
| 2,834,427 | A | * | 5/1958 | Powers et al. | 181/243 |
| 2,966,226 | A | * | 12/1960 | Kalis | 181/243 |
| 3,233,699 | A | * | 2/1966 | Plummer | 181/243 |
| 4,513,596 | A | | 4/1985 | Usher | |
| 4,567,742 | A | | 2/1986 | Castricum | |
| 4,585,091 | A | * | 4/1986 | Budd | 181/243 |
| 4,864,712 | A | | 9/1989 | Carden et al. | |
| 4,924,684 | A | | 5/1990 | Castricum | |
| 5,049,424 | A | | 9/1991 | Carden et al. | |
| 5,105,639 | A | | 4/1992 | Castricum | |
| 5,193,374 | A | | 3/1993 | Castricum | |
| 5,257,521 | A | | 11/1993 | Castricum | |
| 5,692,300 | A | | 12/1997 | Conn et al. | |
| 5,860,305 | A | | 1/1999 | Castricum | |
| 5,943,891 | A | | 8/1999 | Takagi et al. | |
| 5,980,744 | A | | 11/1999 | Gagnon et al. | |

* cited by examiner

*Primary Examiner*—Khanh Dang
(74) *Attorney, Agent, or Firm*—Harness, Dickey & Pierce, P.L.C.

(57) ABSTRACT

A lock seam for joining a first edge of material to a second edge of material is described. The first edge is wrapped in a first curl such that the first curl is substantially circular in shape. The second edge is wrapped in a second curl which is also substantially circular in shape. The inside surface of the first curl is wrapped about the outer surface of the second curl. The lock seam formed by this manner is particularly advantageous for muffler assembly.

13 Claims, 3 Drawing Sheets

LOCK SEAM FOR CANISTERS

FIELD OF THE INVENTION

The present invention relates generally to the joining of the ends or edges of one or more pieces of material, and more particularly to joining the ends of a muffler shell to produce a sound mechanical joint having an aesthetically pleasing appearance.

BACKGROUND OF THE INVENTION

Various methods have been employed to join two pieces of material together in current manufacturing and assembly technologies. For instance, welding and mechanical joining pieces of sheet metal together, especially the ends or edges thereof.

In conventional muffler assembly, a piece of sheet metal is typically wrapped around a muffler assembly, thereby encapsulating and supporting the internal components. The sheet metal is welded or mechanically joined together at its respective ends to form a seam.

While welding structurally provides a sound method of joining the respective ends of the sheet metal together, this method fails to provide an aesthetically pleasing appearance for the resulting muffler. As such, manufacturers are typically required to provide a second housing (e.g., a cover or wrap) over the sheet metal cover to hide the unsightly weld marks on the sheet metal.

Therefore, there existed a need in the relevant art to provide a method of joining two ends of sheet metal in such a way as to provide a sound structural joint which is also aesthetically pleasing. Examples of joining techniques can be found in U.S. Pat. Nos. 4,513,596; 4,567,742; 4,864,712; 4,924,684; 5,049,424; 5,105,639; 5,193,374; 5,247,521; 5,692,300; 5,860,305; 5,943,891; and 5,980,744, the entire specifications of which are incorporated herein by reference.

One method used to join respective ends of sheet metal involved the use of a lock seam. The lock seam method employs forming the respective ends into an interlocking set of folds which cooperate to maintain the two respective ends joined. While this method does provide an aesthetically pleasing and structurally sound joint, its creation requires force to be applied on the joint in a direction toward the muffler body. However, the internal components of the muffler provide little or no support to most of the cover area of the sheet metal. As such, application of this type of joint causes deformation and damage to the outer shell of the muffler.

A further concern with respect to lock seams is their structural integrity. Commonly, these seams incorporate a series of flat folds which provides room for lateral movement of the respective ends in the seam, thereby weakening the joint.

In view of the above, it would be desirable to manufacture a lock seam that is mechanically sound and also aesthetically pleasing, but does not require force to be applied in a direction toward the body of the muffler when it is formed.

SUMMARY OF THE INVENTION

In view of the above, it is an object of the present invention to provide a lock seam which does not require force to be exerted in a direction toward the body to be sealed.

It is a further object of the present invention to provide a lock seam which provides a structurally sound joint that is also aesthetically pleasing to view.

In accordance with the broad teachings of this invention, a lock seam having an advantageous construction and method of assembly is provided. The lock seam for joining a first edge of material to a second edge of material has the first edge wrapped in a first curl such that the first curl is substantially circular in shape. The second edge is wrapped in a second curl which is also substantially circular in shape. The inside surface of the first curl is wrapped about said outer surface of said second curl.

In a further aspect of the present invention, a pressureless lock seam is utilized in conjunction with a muffler. By the term "pressureless" as that term is used herein, it is meant that the lock seam is formed without the application of any substantial amount of pressure directly toward the body to be sealed (i.e., perpendicular to the body). The lock seam of the present invention is formed by the application of forces that are substantially parallel to the body to be sealed. The muffler has a muffler canister, an inlet head/bushing and an outlet head/bushing positioned on opposite sides of the canister. An outer wrap is provided which encapsulates the canister. The outer wrap is positioned flush against and extending around the periphery of the inlet head/bushing and the periphery of the outlet head/bushing. The outer wrap is then joined by a lock seam produced in accordance with the general teachings of the present invention.

In accordance with one embodiment of the present invention, a muffler is provided, comprising:

a muffler canister; and an outer wrap encapsulating the canister, the outer wrap positioned substantially flush against and extending substantially around the periphery of the muffler canister, the outer wrap having spaced and opposed first and second edges, the first and second edges being joined together by a pressureless seam.

In accordance with another embodiment of the present invention, a muffler is provided, comprising:

a muffler canister;

an inlet head and an outlet head positioned on opposite sides of the canister, the inlet head having a substantially planar portion with a periphery flanging back along a first direction, the outlet head having a substantially planar portion with a periphery flanging back along a second direction, wherein the first and second directions extend away from the canister; and an outer wrap encapsulating the canister, the outer wrap positioned substantially flush against and extending substantially around the periphery of the muffler canister, the outer wrap having spaced and opposed first and second edges, the first and second edges being joined together by a pressureless seam.

In accordance with yet another embodiment of the present invention, a pressureless seam for joining a first edge of material to a second edge of material is provided, the seam comprising:

the first edge wrapped in a first curl, the first curl being substantially circular in shape, the first curl having an inside surface; and the second edge wrapped in a second curl, the second curl being substantially circular in shape, the second curl having an outer surface;

wherein the inside surface of the first curl is wrapped about the outer surface of the second curl.

Further areas of applicability of the present invention will become apparent from the detailed description provided hereinafter. It should be understood that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

The same reference numerals refer to the same parts throughout the various Figures.

DETAILED DESCRIPTION OF THE PREFERRED EMBODIMENTS

The following description of the preferred embodiment(s) is merely exemplary in nature and is in no way intended to limit the invention, its application, or uses.

Figure 1:
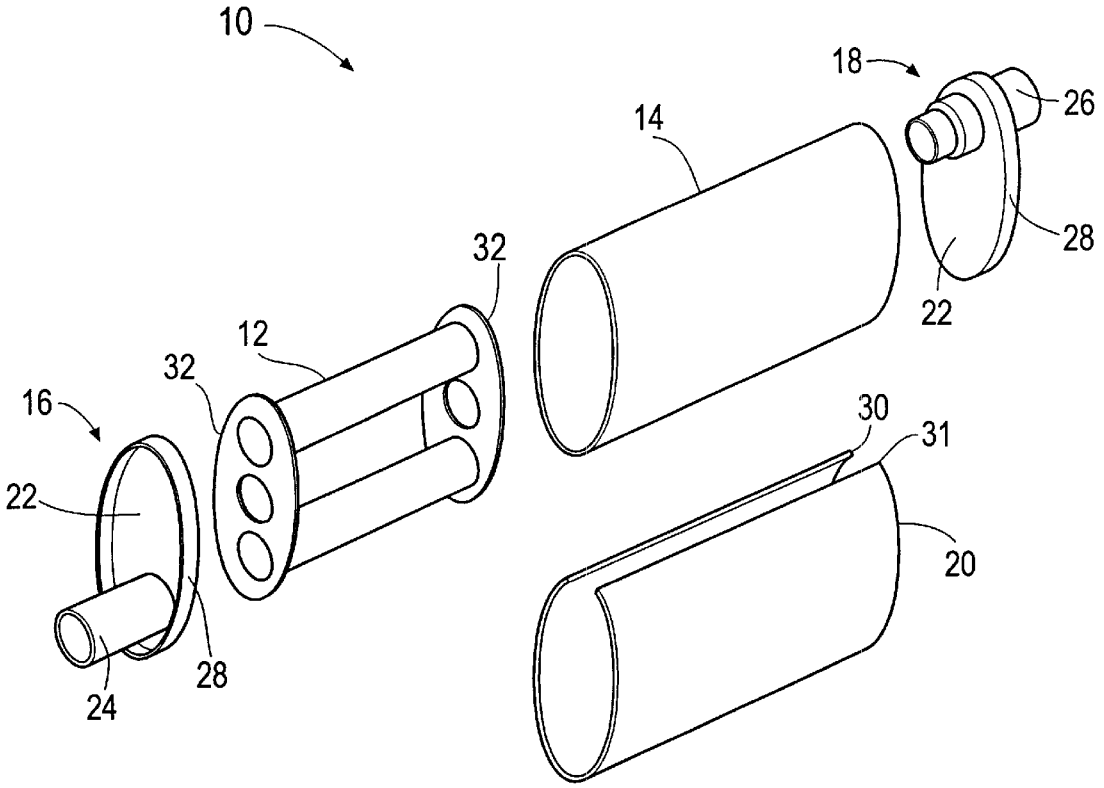
FIG. - 1 (PRIOR ART)
FIG. 1 is an exploded view of a muffler, according to the prior art.

Referring now to FIG. 1, an exploded view of a muffler 10 according to the prior art is shown generally having a muffler canister 12 (typically including one or more tubes having one or more canister plates 32 attached thereto), muffler shell 14, inlet head/bushing 16, outlet head/bushing 18, and outer wrap 20. Inlet head/bushing 16 and outlet head/bushing 18 each have a face portion 22 which supports respective inlet bushing 24 and outlet bushing 26, Inlet head/bushing 16 and outlet head/bushing 18 include respective flange portions 28 which extend from face portions 22 in a direction away from muffler shell 14.

When assembled, muffler canister 12 is first slid into muffler shell 14 and may be then welded thereto. Outer wrap 20 is then wrapped about muffler shell 14 where a mechanical lock seam is formed along edges 30 and 31 to mechanically affix outer wrap 20 about muffler shell 14. Inlet head/bushing 16 and outlet head/bushing 18 are then slid into muffler shell 14 on either side of muffler canister 12 and then mechanically attached thereto.

Figure 3:
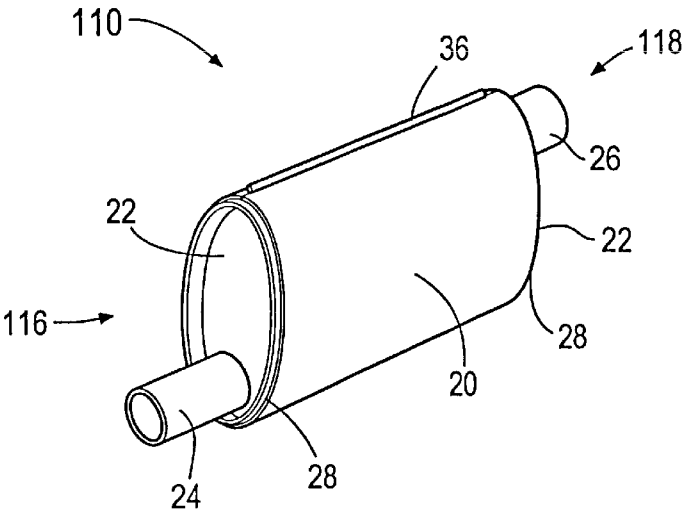
FIG. 3 is a perspective view of an assembled muffler, according to the present invention.
Figure 2:
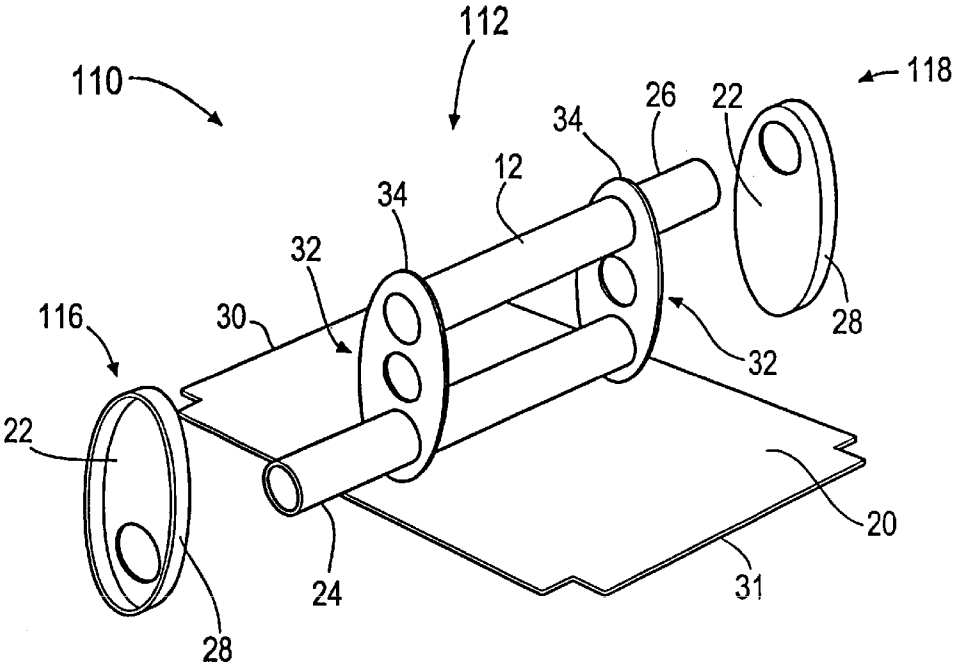
FIG. 2 is an exploded view of an unassembled muffler, according to the present invention.

Referring now to FIGS. 2 and 3, one embodiment of the present invention is shown and described. FIG. 2 illustrates a muffler canister assembly 112, consisting of muffler 12 and attached inlet bushing 24 and outlet bushing 26, positioned on a sheet of outer wrap 20 with inlet head 116 and outlet head 118 shown exploded outwardly therefrom. It should be appreciated that the inlet bushing 24 and outlet bushing 26 do not have to be previously attached to the muffler 12 in order to practice the present invention. The muffler canister assembly 112 illustrates that sub-assemblies can be used to speed up the manufacturing process and reduce overall part cost and content. Outer wrap 20 is wrapped about the periphery 34 of each canister plate 32. Then, edges 30 and 31 are joined together by a mechanical lock seam according to the present invention. By way of a non-limiting example, edges 30 and 31 are placed in abutting relationship, wherein one edge extends slightly past or above the other edge. The abutting edges are then manipulated in such a manner so as to produce the lock seam shown of the present invention. By way of a non-limiting example, this can be accomplished by the selective application of one or more forces (e.g., bending or pushing forces) to the abutting edges, wherein the force is substantially perpendicular to the abutting edges, or expressed differently, substantially parallel to the body to be sealed (e.g., muffler canister 12). Inlet head 116 and outlet head 118 are then slid into muffler shell 20 and mechanically attached to shell 20. Inlet bushing 24 and outlet bushing 26 are mechanically locked to inlet head 116 and outlet head 118, respectively.

FIG. 3 shows the resulting constructed or assembled muffler 110. It should be noted that lock seam 36 joins edges 30 and 31 of outer wrap 20.

Figure 4:
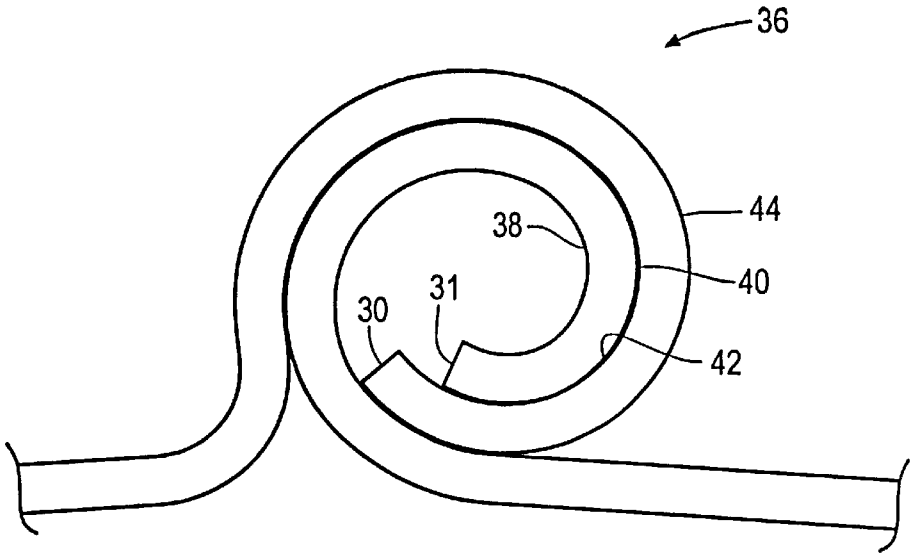
FIG. 4 is a cross-sectional view of a lock seam, according to the present invention.

Referring now to FIG. 4, end 31 is shown having outer surface 38 and inner surface 40. Likewise, end 30 is shown having inner surface 42 and outer surface 44. Ends 30 and 31 are wrapped in a circular fashion such that inner surface 40 communicates with inner surface 42 to lockingly engage edge 31 with edge 30. The circular shape of edge 31 and edge 30 ensures that a maximum number of points between inner surface 40 and inner surface 42 maintain edges 31 and 30 from moving back and forth in a lateral direction.

Figure 5:
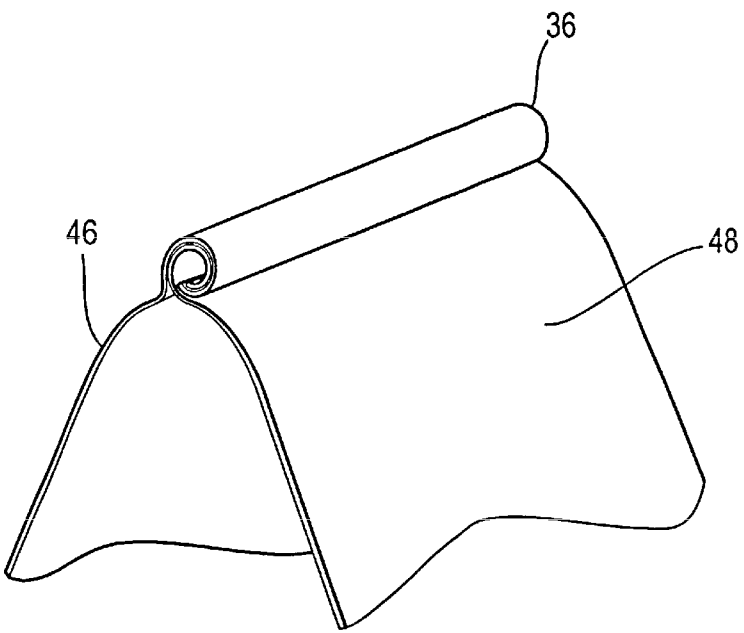
FIG. 5 is a partial perspective view of a lock seam, according to the present invention.

Referring now to FIG. 5, lock seam 36 is shown joining two separate sheets 46 and 48, thereby maintaining these elements in a locked relationship. It should also be noted that lock seam 36 may be used to join two separate ends or edges of a single sheet in the manner shown in FIG. 5.

The invention being thus described, it will be obvious that the same may be varied in many ways. Such variations are not to be regarded as a departure from the spirit and scope of the invention. Such variations or modifications, as would be obvious to one skilled in the art, are intended to be included within the scope of the following claims.

What is claimed is:

1. A muffler comprising:

a muffler canister; and an outer wrap encapsulating said canister, said outer wrap positioned substantially flush against and extending substantially around the periphery of said muffler canister, said outer wrap having spaced and opposed first and second edges, said first and second edges being joined together by a seam comprising said first edge wrapped in a first curl and said second edge wrapped in a second curl wherein an inside surface of said first curl is wrapped about an outer surface of said second curl, wherein an inner surface of said second curl defines substantially an entire wall of an aperture passing axially through a center area of said seam, whereby said seam is formed without exerting pressure against said canister.

2. The invention according to claim 1, further comprising an inlet head and an outlet head positioned on opposite sides of said canister, said inlet head having a substantially planar portion with a periphery flanging back along a first direction, said outlet head having a substantially planar portion with a periphery flanging back along a second direction, wherein said first and second directions extend away from said canister.

3. The invention according to claim 1, wherein said first curl is substantially circular in shape and said second curl is substantially circular in shape.

4. The invention according to claim 1, wherein said first curl and said second curl are continuously curved to form said seam.

5. A muffler comprising;

a muffler canister;

an inlet head and an outlet head positioned on opposite sides of said canister, said inlet head having a substantially planar portion with a periphery flanging back along a first direction, said outlet head having a substantially planar portion with a periphery flanging back along a second direction, wherein said first direction and said second direction extend away from said canister; and an outer wrap encapsulating said canister and contacting said peripheries of said inlet head and said outlet head, said outer wrap positioned substantially flush against and extending substantially around the periphery of said muffler canister, said outer wrap having spaced and opposed first and second edges, said first and second edges being joined together by a seam comprising said first edge wrapped in a first curl and said second edge wrapped in a second curl wherein an inside surface of said first curl is wrapped about an outer surface of said second curl, wherein said first curl and said second curl are continuously curved to form said seam, whereby said seam is formed without exerting pressure against said canister.

6. The invention according to claim 5, wherein said first curl is substantially circular in shape and said second curl is substantially circular in shape.

7. The invention according to claim 5, wherein an inner surface of said second curl defines substantially an entire wall of an aperture passing axially through a center area of said seam.

8. A seam for joining a first edge of material to a second edge of material, said seam comprising:

said first edge wrapped in a first curl having an inside surface;

said second edge wrapped in a second curl having an outer surface; and wherein said inside surface of said first curl is wrapped about said outer surface of said second curl, wherein said first curl and said second curl are continuously curved to form said seam.

9. The invention according to claim 8, wherein the material is one piece of sheet metal.

10. The invention according to claim 8, wherein the material is wrapped around a support structure, said support structure having a plurality of partitions, each of said plurality of partitions positioned parallel to a remainder of said partitions and having an outer periphery, the material being wrapped around said outer periphery of each of said plurality of partitions such that said plurality of partitions provides sole structural support for the material.

11. The invention according to claim 8, wherein the material comprises a first piece of material and a second piece of material, said first piece of material having said first edge and said second piece of material having said second edge.

12. The invention according to claim 8 wherein the first and second curls are substantially circular in shape.

13. The invention according to claim 8, wherein an inner surface of said second curl defines substantially an entire wall of an aperture passing axially through a center area of said seam.

* * * * *